US005498448A

United States Patent [19]

Hashimoto

[11] Patent Number: 5,498,448

[45] Date of Patent: Mar. 12, 1996

[54] METHOD FOR PROCESSING WOOD WITH VAPOR

[75] Inventor: Yotaro Hashimoto, Shiga, Japan

[73] Assignee: Eiwa Co., Ltd., Shiga, Japan

[21] Appl. No.: 277,440

[22] Filed: Jul. 19, 1994

[30] Foreign Application Priority Data

Jul. 20, 1993 [JP] Japan ..... 5-179397

[51] Int. Cl.[6] ..... C23C 16/00

[52] U.S. Cl. ..... 427/255.6; 422/28; 422/37; 427/297; 427/440

[58] Field of Search ..... 427/297, 440, 427/255.6; 422/28, 37

[56] References Cited

U.S. PATENT DOCUMENTS

| | | | |
|---|---|---|---|
| 3,685,959 | 8/1972 | Dunn, Jr. et al. | 21/7 |
| 3,948,802 | 4/1976 | Liddell | 252/404 |
| 3,959,529 | 5/1976 | Winn et al. | 427/335 |
| 3,967,011 | 6/1976 | Dunn, Jr. et al. | 427/345 |
| 4,313,977 | 2/1982 | Johnson et al. | 427/297 X |
| 4,399,195 | 8/1983 | Allen | 427/297 X |
| 5,270,083 | 12/1993 | Lotz | 427/297 X |

*Primary Examiner*—Michael Lusignan
*Attorney, Agent, or Firm*—Knobbe, Martens, Olson & Bear

[57] ABSTRACT

Halogenated hydrocarbon solution, water, and surfactant solution are mixed together; said mixture solution is heated for generating halogenated hydrocarbon gas, water vapor, and surfactant gas; said mixture gas is filled into a processing tank in which wood has been hermetically contained so as to permeate into said wood; and resin in wood is dissolved so that pits of the membrane of wood cells may be opened. As said halogenated hydrocarbon solution, used is methylene chloride solvent solution.

6 Claims, 8 Drawing Sheets

| OPERATING STEP \ OPEN OR CLOSE VALVE | 1 | 2 | 3 | 4 | 5 | 6 | 7 | 8 | 9 | 10 | 11 | 12 | 13 | VACUUM PUMP |
|---|---|---|---|---|---|---|---|---|---|---|---|---|---|---|
| DEAERATION | + | − | + | − | − | − | − | − | − | − | − | − | − | ON |
| FEED OF MIXTURE SOLUTION | − | − | − | + | − | − | − | − | − | − | − | − | − | OFF |
| PROCEEDING OF IRON MATERIAL | − | − | − | − | − | − | + | − | + | − | − | − | − | OFF |
| COOLING OF MIXTURE SOLUTION | − | − | − | − | − | − | − | + | − | + | − | − | − | OFF |
| RETURN OF MIXTURE SOLUTION TO TANK | − | + | − | − | + | + | − | − | − | − | − | + | + | OFF |
| RECOVERY OF MIXTURE SOLUTION GAS | + | − | + | − | − | − | − | − | − | − | − | − | − | ON |
| RECOVERY OF MIXTURE SOLUTION IN CONDENSER | − | + | − | − | − | − | − | − | − | − | + | − | − | OFF |

*Fig. 2*

METHOD FOR PROCESSING WOOD WITH VAPOR

TITLE OF THE INVENTION

Method of Processing Wood with Fumigation

FIELD OF THE INVENTION

This invention consists in a technique enabling easy extraction of oils and fats from wood, speeding up drying of wood, and also enabling easier application of dyeing and preservative processing to wood dependently on fumigation in which wood is subjected to permeation of gas therethrough instead of immersion thereof into a chemical solution, and oils and fats closing the pit part of wood, each pit closing the cell of wood, are dissolved so that said pit of wood may be opened.

PRIOR ART

As methods of processing wood while immersing wood into halogenated hydrocarbon solution, known are such arts as disclosed in the U.S. Pat. Nos. 3,685,959, 3,948,802, 3,959,529, and 3,967,011.

However, according to the prior arts as above, wood is directly immersed into a halogenated hydrocarbon solution and, as a result of too strong power of said solution as solvent, the surface structure of wood is decomposed as if dissolved, whereby further permeation of halogenated hydrocarbon solution into the inner part of wood stops and removal of oils and fats is impossible.

Accordingly, when injecting preservatives, dyestuff, and resin into wood processed by the prior art, permeation of these chemicals is effective only at the outer part of the wood body and incapable of extending to the inner part.

SUMMARY OF THE INVENTION

This invention, in connection with the conventional technique as above, enables processing of wood by adding surfactant solution to said halogenated hydrocarbon solution, or halogenated hydrocarbon solution and water, or mixture solution of halogenated hydrocarbon solution and water, so that sharpness in dissolution of resin which closes the pit part of wood may be increased, luster of processed wood be improved, and processing of wood with generation of high pressure gas at a low temperature be possible.

BRIEF DESCRIPTION OF THE DRAWING

FIG. 2 is a view showing processes and steps in the method of wood processing by means of indication as ON and OFF of the valve mechanism;

DESCRIPTION OF THE PREFERRED EMBODIMENT

Figure 1:
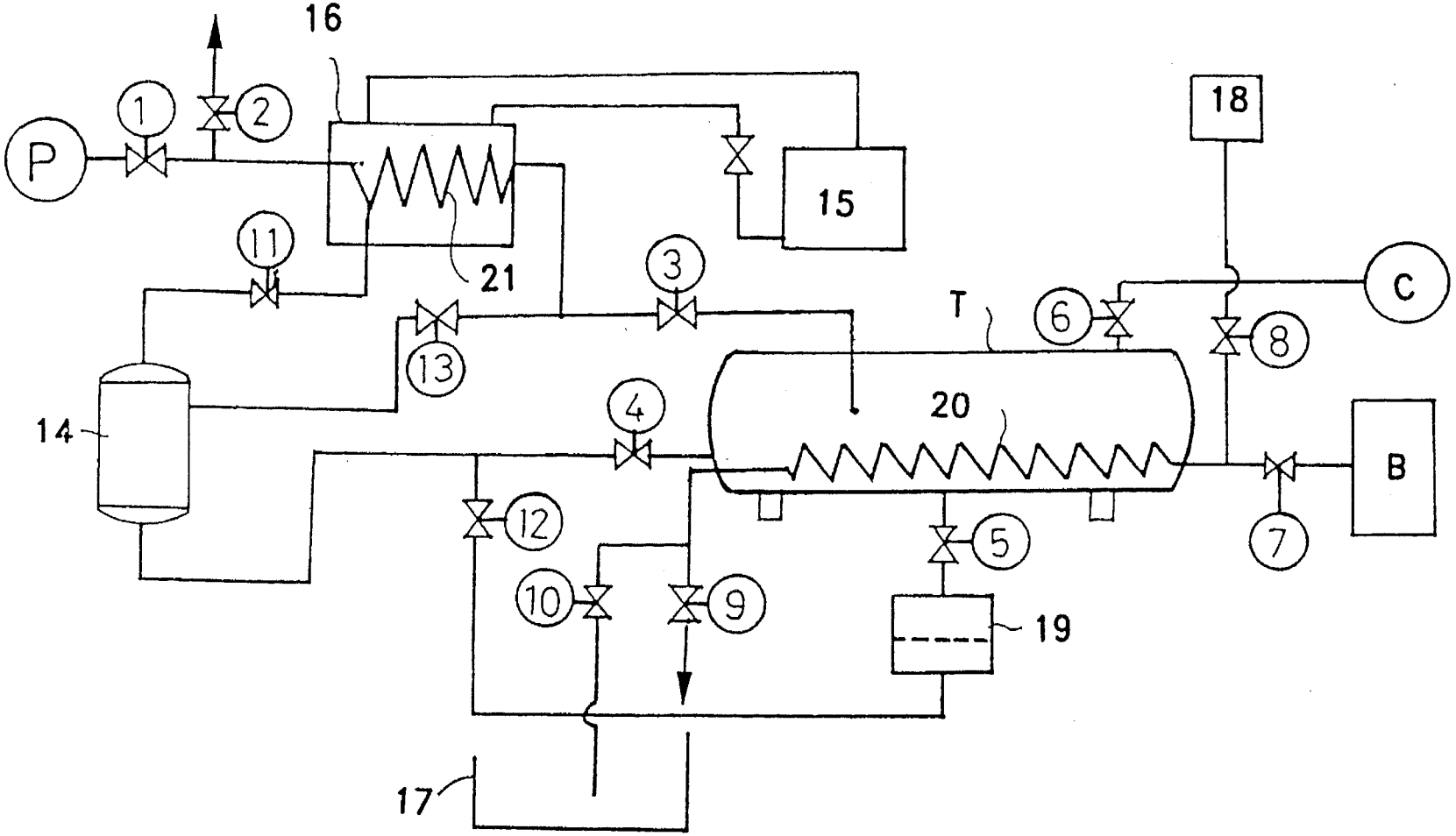
FIG. 1 is a view showing the fundamental composition of a method of and apparatus for processing wood according to this invention.
Figure 3:
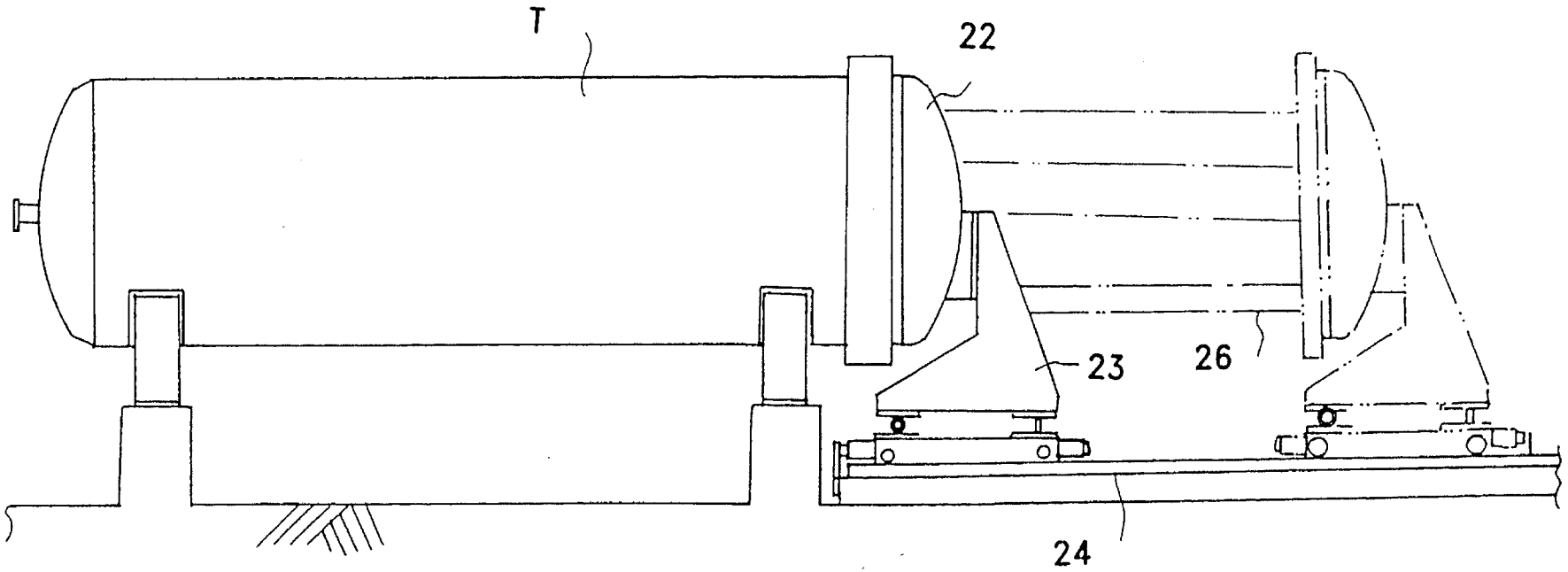
FIG. 3 is a side view of a part including a processing tank T, lid 22, and wood-mounting table 26.
Figure 4:
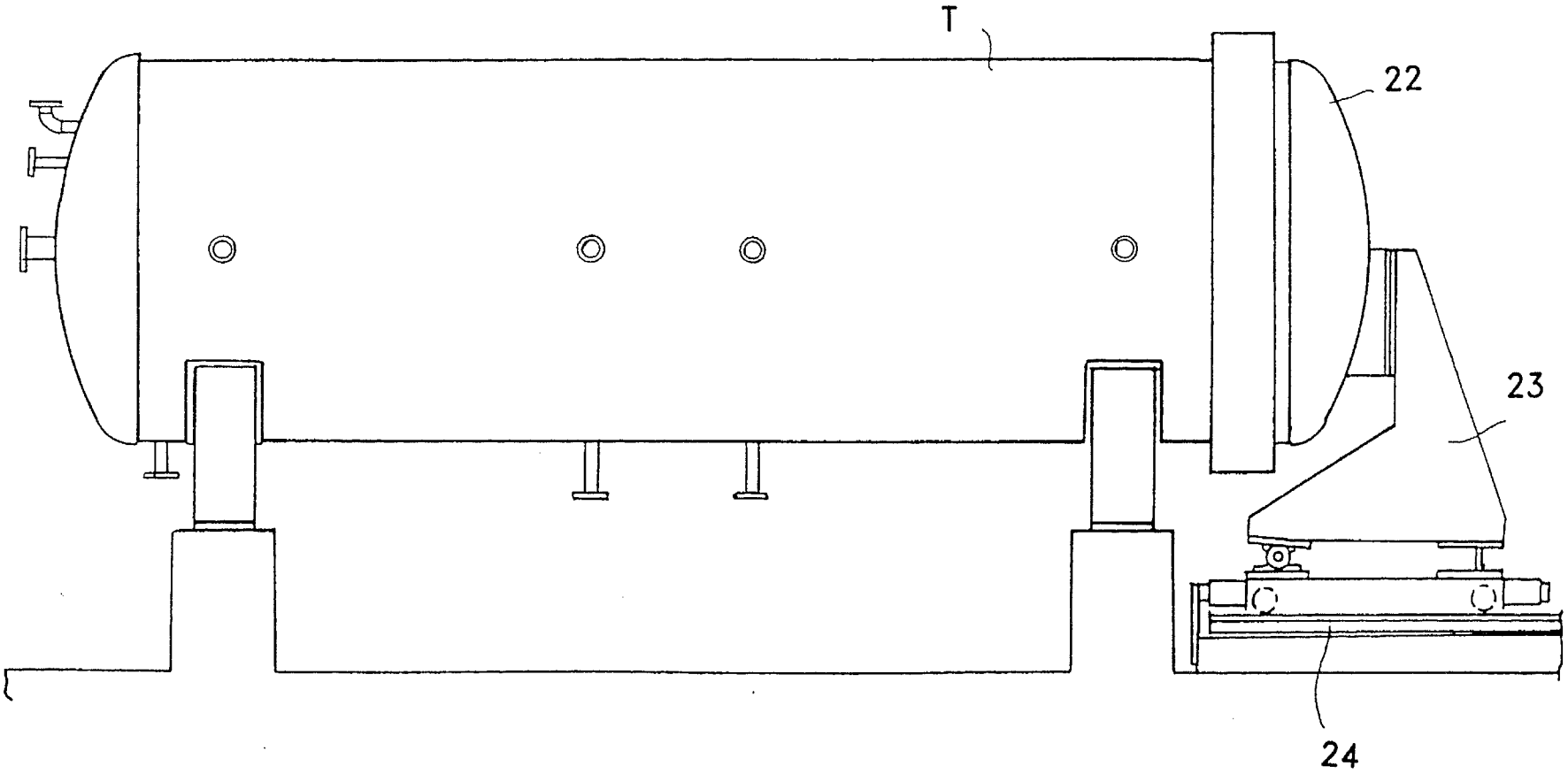
FIG. 4 is a side view of the tank T to which the lid 22 is applied to the tank for closure thereof.
Figure 5:
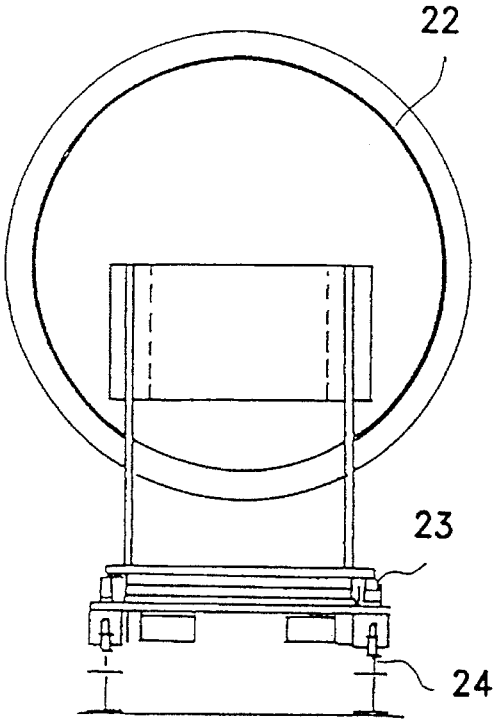
FIG. 5 is a front view of the lid 22.

In an embodiment of the invention as shown hereunder, methylene chloride solvent solution is disclosed as a halogenated hydrocarbon solution, however, the use of other kinds of halogenated hydrocarbon solution may provide the same result. For example, trichloroethylene, tetrachloroethylene, or 111-trichloroethylene suffices.

Further, an embodiment in which water and surfactant solution are added to the methylene chloride solution is shown, however, effects of this invention are exhibited even when halogenated hydrocarbon solution only or methylene chloride solvent solution only is used, or in a state in which water is added to methylene chloride solution, or methylene chloride solvent solution, water, and surfactant solution are mixed together.

On the other hand, it has been found that the highest effect can be obtained when water and surfactant solution are added to methylene chloride solvent solution. Even when halogenated hydrocarbon solution only is used, fat removal effect is exhibited, however, addition of water thereto reduces impairment to the surface of wood caused by chlorine gas. When mixing halogenated hydrocarbon solution or methylene chloride solvent solution with water and surfactant solution, sharpness in fat removal is increased by a surfactant solution, thereby oils and fats removal effect being increased.

An embodiment of the invention will be described hereunder. Methylene chloride is a substance expressed by a chemical formula as $CH_2Cl_2$ and has a molecular weight of 84.93. This substance is sometimes called dichloromethane or methylene dichloride in addition to the general name as methylene chloride. Its boiling point and melting point are 40.4° C. and −96.8° C., respectively.

Surfactants are classified into anionic, cationic, nonionic, and amphoteric ones. Anionic surfactants are alkyl sodium sulfate, amide sodium sulfate, secondary alkyl sodium sulfate, alkyl sodium sulfonate, amide sodium sulfonate, alkylallyl sodium sulfate, and alkyl naphtalene sodium sulfate.

Cationic surfactants are amine acetate salt, alkyl trimethyl ammonium chloride, dialkyl methyl ammonium chloride, alkyl pyridium halogenide, and alkyl dimethyl benzyl ammonium chloride.

As amphoteric surfactants, there are carboxylic acid type, sulfonic acid type, and sulfate type ones. In nonionic surfactants, polyoxyethylene alkylphenol, polyoxyethylene fatty alcohol, polyoxyethylene fatty acid, polyoxyethylenic acid amide, polyoxyethylenic fatty amine, and polypropylene glycol are included.

In the method of processing wood according to this invention, with the increase in alkalinity, $Cl_2$ is liable to be generated and, for prevention thereof, polyoxyethylene alkylphenol in alcoholic system, which is nonionic surfactant relatively stable against acid and alkali, is effective in this respect. However, for dissolving resin of wood and opening pits, all kinds of surfactants are effective.

When heating the mixture of three substances as methylene chloride solution, water, and surfactant solution as performed in this invention, gases and compounds that will be described under are generated in addition to methylene chloride gas, water vapor, and surfactant gas. Gases and compounds referred to above are HCHO, HF, HCl, HBr, $NH_3$, $Cl_2$ (a few quantity), $CH_4$, CO, $CO_2$, organic acid, and organic compounds.

Organic acids are phosphoric, citric, pyruvic, malic, succinic, lactic, formic, acetic, levulinic, pyroglutamic, propionic, isobutyric, and isovaleric acids. Among these organic acids, phospholic acid is effective for development of yellow color and nitric acid as well as succinic acid is also effective for pink color whereas acetic acid removes color for providing whiteness. Chemical actions as above has made it possible to process such woods as hitherto generally called "red cedar" or "black core" and disliked as low quality one in the market because of color depth thereof, and to remove reddish color, decolor black core parts, and turn said wood into high quality one having moderate color and luster.

Organic compounds, when subjected to mass spectrometric analysis with gas chromatograph, have been found originating from essential oil as chain saturated hydrocarbon, sesquiterpene, sesquiterpene alcohol contained in resin of wood. Such compounds are extracted when resin in wood is dissolved by methylene chloride and surfactant.

Referring to FIGS. 3, 4, 5, 6, and 7, the structure including a processing tank T, lid 22, and wood mounting table 26 will be described. The processing tank T is constructed to be a long cylindrical pressure vessel and, in view of such degrees of pressure as 50 Torr for deaeration from wood and 200 Torr for recovery of methylene chloride required in the method of and apparatus for processing wood according to this invention, is adapted to endure the above said degrees of pressure.

The lid 22 is disposed on the front side of the vessel and structurally integral with the wood-mounting table 26. Said table 26 is displaced on the rail 24 provided in the processing tank T and the lid 22 is movable on the rail 24 below the lid supporting part 23 so as to move integrally with said part 23. Wood W as an object to be processed is mounted on the wood-mounting table 26 which is withdrawn and advanced integrally with said lid 22. In the state that said wood-mounting table has been thrusted into and retained in the inner space of the processing tank T, pressure is applied to said inner part after the lid 22 closes the processing tank T hermetically and unmovably. Heating.cooling pipes 20 are arranged on the inner bottom of said processing tank T and, when heating is intended, steam having a temperature amounting to 100 and several tens° C. is supplied from the boiler B. For cooling, water in the cooling water tank 18 is supplied. A mixture solution of methylene chloride and water may be poured into the processing tank as it is or after changed into mixed gas in a preparatory tank. In the embodiment shown in FIG. 1, the mixture is fed into the processing tank while kept liquid.

The mixture solution, while kept as it is, is poured into the tank to such extent as immersing the heating.cooling pipes 20 and then steam having the temperature amounting to 100 and several tens° C. is fed from the boiler B to the heating-.cooling pipes 20, when not only methylene chloride having the boiling point of 40° C. but also water turns into vapor. The reason why steam and methylene chloride gas are fed at the same time lies in the promotion of opening of pits with softening of the outer peripheral structure of wood and also promotion of permeation of methylene chloride gas into the cell of wood. For reducing unavoidable generation of chlorine gas in methylene chloride gas to change color of wood or rot wood, chlorine gas is arrested after passed through the water layer, combined with water, and turned into hydrochloric acid.

Figure 6:
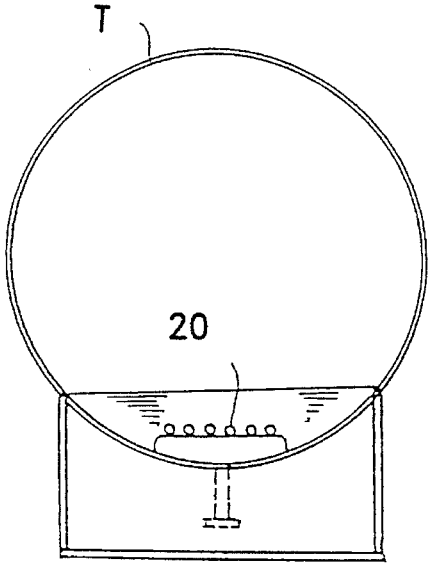
FIG. 6 is a sectional front view of the processing tank T.
Figure 7:
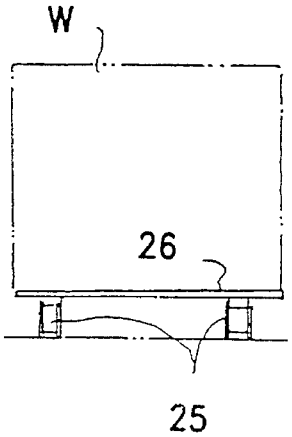
FIG. 7 is a front view showing a state in which wood W is mounted on the wood-mounting table 26.

In this invention, as shown in FIG. 6, the mixture solution of methylene chloride, water, and surfactant reaches no other level than that below the wood-mounting table 26 even at the highest and wood is not immersed into the mixture solution. The method of this invention entirely depends on fumigation in which wood is processed with mixture solution gas absorbed thereinto.

Referring to FIG. 1, the fundamental composition of the method and apparatus of this invention will be described. As an apparatus, the main components thereof are the processing tank T and mixture solution tank 14, wherein a mixture solution of methylene chloride, water, and surfactant is thrown into said tank 14. The boiler B, as previously described, serves for gasifying the mixture solution and a compressor C operates to apply pressure when returning mixture solution in the processing tank T to the mixture solution tank 14 after completion of processing.

A vacuum pump P operates for absorbing methylene chloride gas remaining in the processing tank T and the cell structure of wood W after the mixture solution is forcedly discharged. Methylene chloride gas thus absorbed is not allowed to be discharged into atmosphere and, therefore, is liquefied after cooled in the condenser and is returned to the mixture solution tank 14 through the condenser pipe 21. A chiller 15 cools cooling water in said condenser 16. A filter 19 is provided for filtering off impurities such as dusts in the mixture solution forced out from the processing tank T by the compressor C. The cooling water tank 17 is a receptacle for cooling water used for liquefaction of mixture solution gas.

Solenoid valves are arranged at various parts. Such solenoid valves are constructed to be opened and closed by an automatic control device at fixed intervals and automatically operated in steplike order such as (deaeration from wood), (feed of mixture solution), (fat removal from wood), (cooling of mixture solution), (return of mixture solution to tank), (recovery of mixture solution gas), and (recovery of mixture solution in condenser).

At the same time, the compressor C, boiler B, vacuum pump P, and chiller 15 are automatically driven and stopped. One cycle of this process is designed to be completed within 24 hours and wood W, if having been subjected to said process, is dried in the drying device at a considerably higher speed than that required for non-processed wood.

In FIG. 2, a state of the solenoid valve in every step in the wood processing method and apparatus is shown. In the process of (deaeration from wood), the vacuum pump P is driven. A solenoid valve 1 in the circuit to connect the vacuum pump P to the condenser 16 as well as another valve 3 adapting the condenser 16 to communicate with the processing tank T is also opened. The other solenoid valves are all closed. In this way, the inner space of the processing tank T is made vacuum to a degree of about 50 Torr, whereby air in the cell of wood W is drawn out.

Then, in the process of (feed of mixture solution), the solenoid valve for adapting the processing tank T to communicate with the mixture solution tank 14 is opened whereas the other valves are closed. Thus, the mixture solution moves to the inner part of the. processing tank T so that the level of solution in the mixture solution tank may be flush with that in the processing tank T since both tanks are arranged at the approximately same levels.

In the process of (fat removal from wood), the solenoid valve 7 between the boiler B and the processing tank T and another solenoid valve 9 adapting the processing tank T to communicate with the drain are opened whereas the other valves are closed. Then, steam of high temperature coming from the boiler B is fed to the heating.cooling pipes 20 and the mixture solution in the processing tank T changes into methylene chloride gas, water vapor, and surfactant gas so as to permeate into the cells of wood W. The step of this process of (fat removal from wood) continues for about 6 hours.

The process of (cooling of mixture solution) will be described. In this case, a solenoid valve 8 adapting the cooling water tank 18 to communicate with the processing tank T and another valve 10 adapting the processing tank T to communicate with the cooling tank 17 are opened whereas the other valves are closed. Thus, cooling water passes through the inner part of the heating.cooling pipes 20 and a temperature in the inner part of the processing tank T falls below 40° C. that is the boiling point of methylene chloride, whereby both methylene chloride gas and water are returned to liquid.

The process of (return of mixture solution to tank) will be described. In this case, a solenoid valve 2 is opened for escape of air in the processing tank T and another solenoid valves 5 under the processing tank T as well as further one 6 adapting the compressor C to communicate with the processing tank T is opened so as to drive the compressor C. On the other hand, a solenoid valve 12 between the filter 19 and the mixture solution tank 14 and another valve 13 adapting the mixture solution tank 14 with the atmosphere are opened. Then, some degree of pressure acts on the inner part of the processing tank T and liquefied mixture gas is forcedly returned to the mixture solution tank 14.

The process of (recovery of mixture solution gas in tank) will be described. In this case, the vacuum pump P is driven. A solenoid valve 1 adapting the vacuum pump P to communicate with the condenser 16 and another valve 3 adapting the condenser 16 to communicate with the processing tank T are opened. The other valves are closed. In this state, methylene chloride gas present in the processing tank T and having permeated into the cells of wood is recovered by the vacuum pump P. In this case, a degree of vacuum is lowered to about 200 Torr.

In the process of (recovery of mixture solution in condenser), a solenoid valve 2 communicating with the atmosphere and another valve 11 adapting the condenser pipe 21 to communicate with the mixture solution tank 14 are opened. Hence, recovery of mixture solution such as methylene chloride remaining in the condenser pipe 21 of the condenser 16 can be recovered into the mixture solution tank 14. A series of such processes as above is completed after a lapse of 24 hours.

Figure 8:
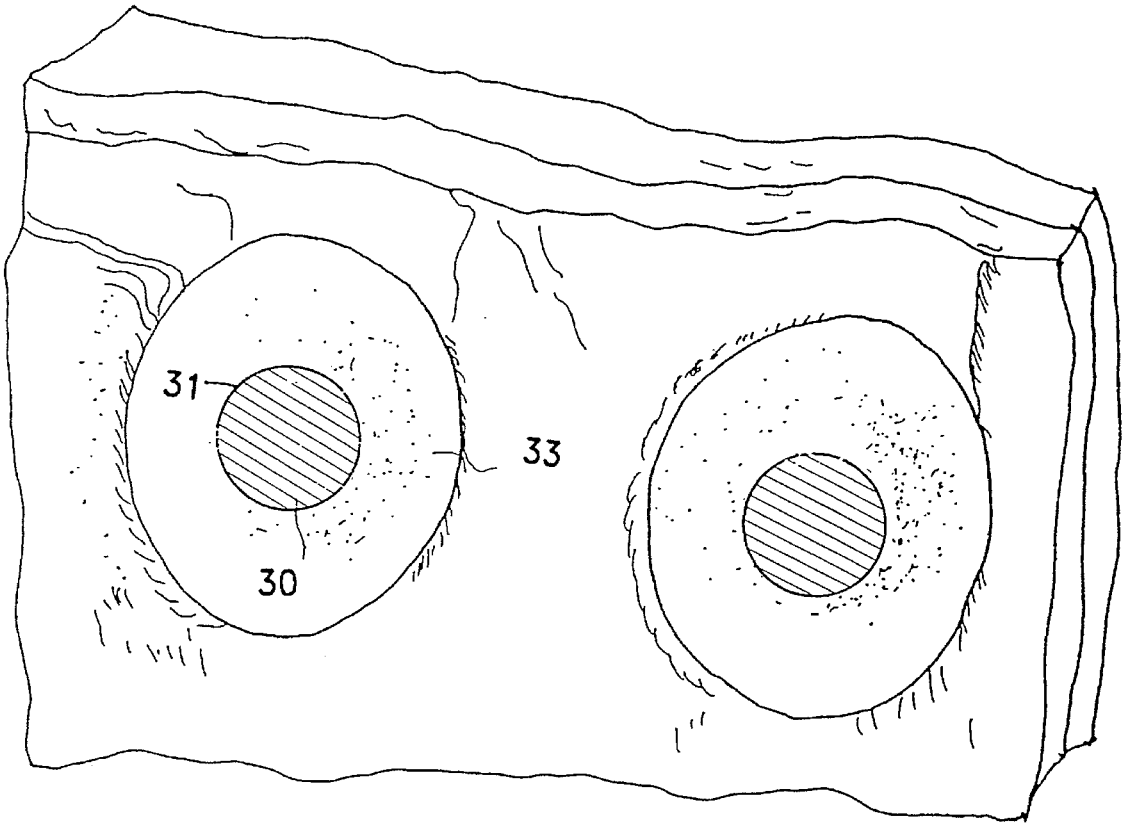
FIG. 8 is a perspective view of pits 30 of the needle-leaf tree.
Figure 9:
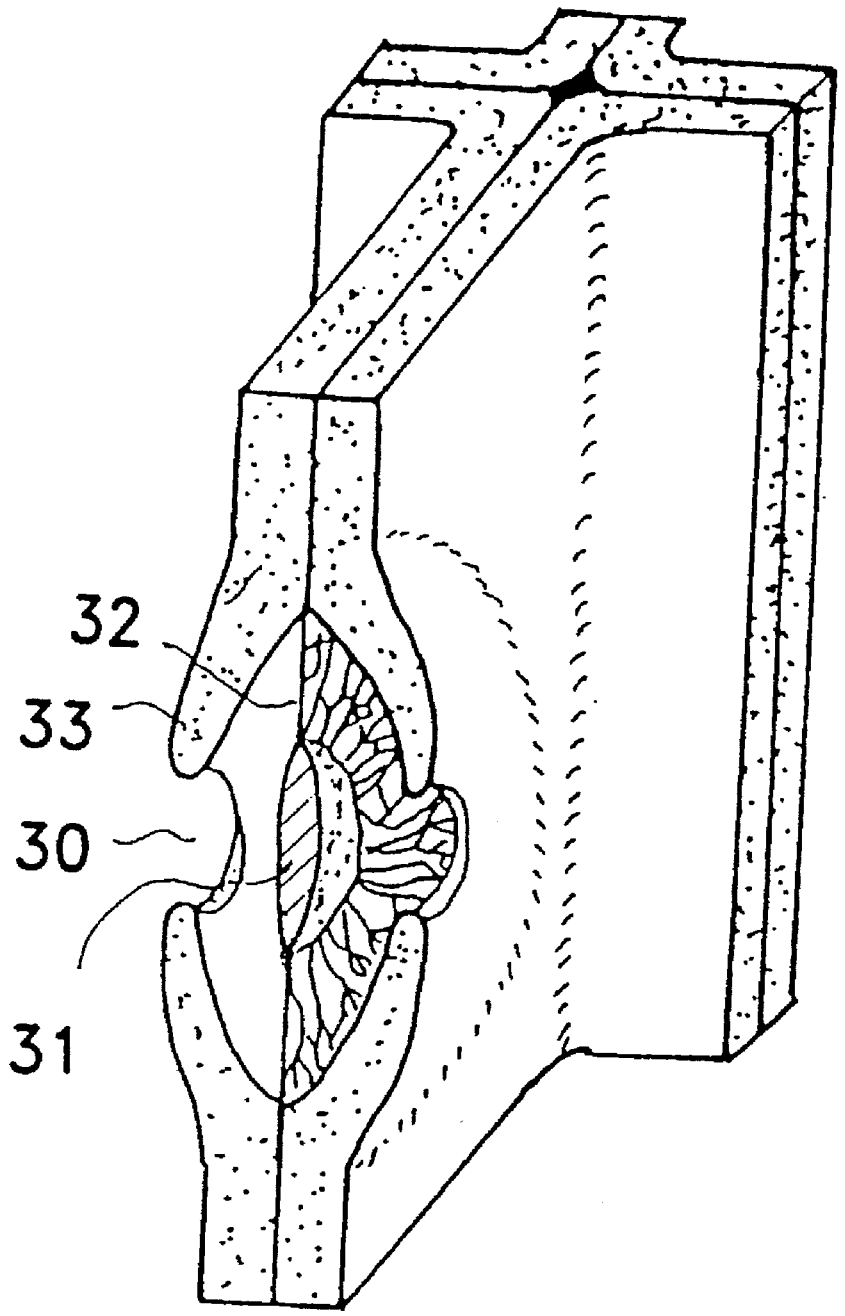
FIG. 9 is a sectional view of a pit 30 as above.

In FIGS. 8 and 9, the structure of a pit of the needle-leaf tree exemplifying wood W is shown. A dome-like shape is formed by edges 33.33 of a hole on a part of the cell wall and the center surrounded by said edges 33.33 is made open as a pit 30. A torus 31 acts as a valve to open and close said pit 30 and is suspended by margo 32 which is a net-like membrane composed of net-like cellulose.microfibrils.

With the decrease and increase in quantity of water in the cell, said torus 31 closes the pit 30 and opens it while departing therefrom, respectively. Said margo 32 composed of cellulose.microfibrils allows passage of water therethrough and the pit can be opened when the torus 31 is brought into such a state as not closing the pit 30. This invention is intended to dissolve oils and fats present in the cellulose.microfibril part with methylene chloride, water vapor, and surfactant gas so as to prevent the torus 31 from closing the pit 30.

Figure 10:
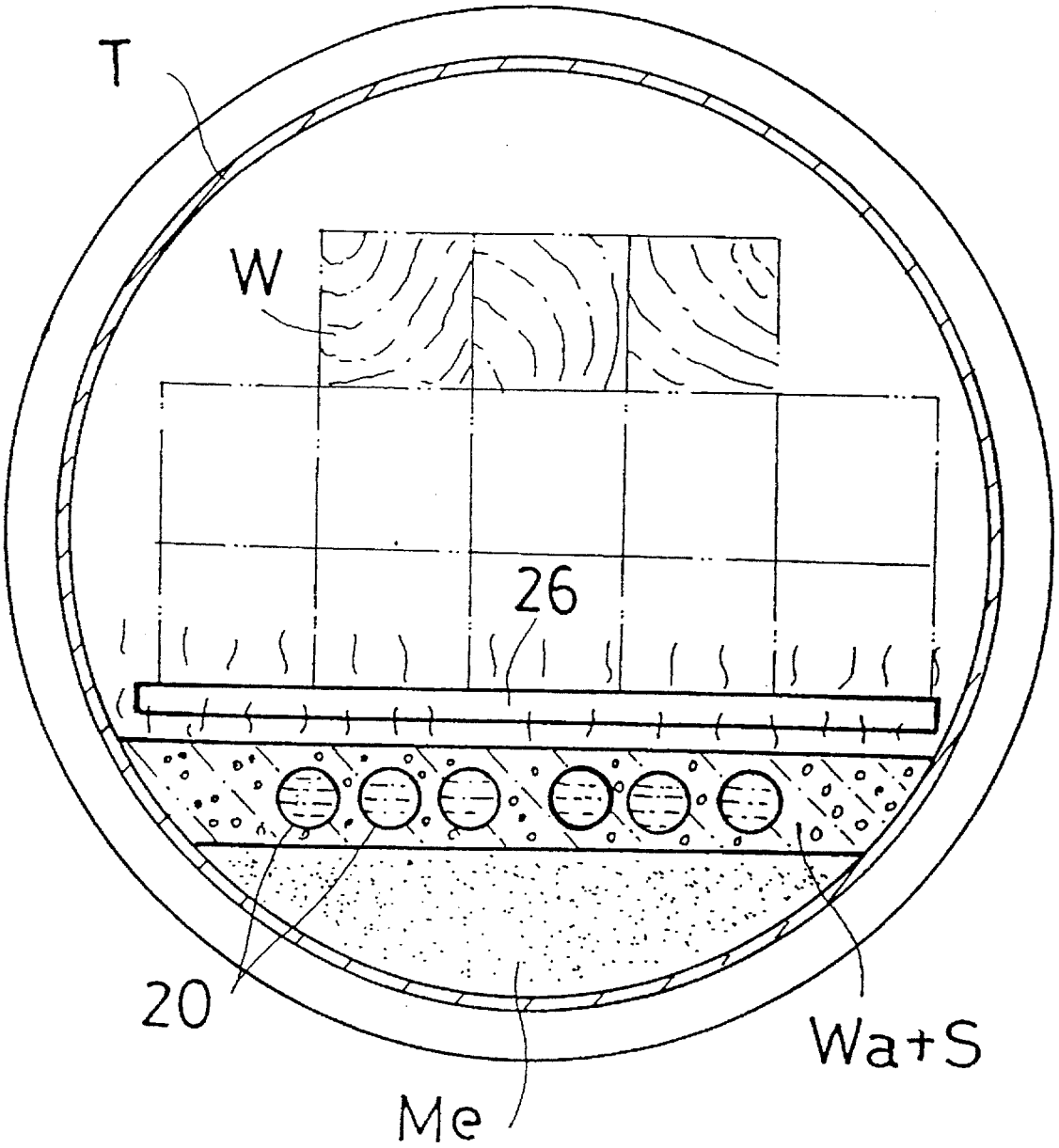
FIG. 10 is a sectional view of the inner part of the processing tank T in operation of processing.

Referring to FIG. 10, a description will be made on the section of the inner part of the processing tank T in operation of processing. The heating.cooling pipes 20 are disposed on the inner lower part of the processing tank T and the wood-mounting table 26 is disposed above said heating-.cooling pipe 20. Wood is mounted on said wood-mounting table 26. The mixture of water Wa, surfactant solution S, and methylene chloride solution Me is poured into the tank to be higher in level than said heating.cooling pipes 20, however, to such extent as not immersing wood W on the wood-mounting table 26 into the solution.

Water Wa and surfactant solution S having specific weight of 1.00 and 1.04, respectively, are on the approximately same levels and the latter S dissolves into the former W to be in one body, thereby composing a layer of (water Wa+surfactant solution S) as shown in FIG. 1. In contrast with this, methylene chloride solution Me having the specific weight of 1.33 and incapable of dissolving into water Wa forms a layer beneath the layer of (water Wa+surfactant solution S). When steam heated to 160° C. is fed to the heating.cooling pipes 20 disposed in the (water Wa+surfactant solution S) layer, the temperature of parts around the heating.cooling pipes 20 rises. Said heating.cooling pipes 20 are arranged in the layer of (water Wa+surfactant solution S) and the temperature of parts near said layer rises earlier than that of the other parts.

When the temperature of the heating.cooling pipes 20 gradually rises and reaches about 40° C., methylene chloride solution Me is heated to reach the boiling point thereof, turns into methylene chloride gas divided into bubbles, passes through the layer of (water Wa+surfactant solution S), and reaches wood W so as to permeate into pores of said wood W.

In the usual processing of wood and in the case of soft wood W as the Japanese cedar, the processing operation continues in a state that the mixture solution is heated to about 70° C. and methylene chloride gas passes through the mixture solution of water Wa and surfactant solution S and reaches wood W.

In the case of the needle-leaf tree as the pine, above all, such wood W as exuding resin much, the mixture solution is heated to about 80° C. and said wood is processed with not only water Wa but surfactant solution turned into gas. While said methylene chloride Me passes through water Wa and surfactant solution S, $Cl_2$ (chlorine gas) generated from methylene chloride is absorbed into water Wa and controlled not to be generated further for preventing unfavorable influence thereof from falling on processing. Methylene chloride gas permeates into pores of wood W while attended with surfactant solution S. Hence, removal of fat is sharpened.

In this way, because of a process to prepare a solution containing water Wa, surfactant S, and methylene chloride Me and to heat said solution with heating.cooling pipes 20, methylene chloride Me evaporates into the processing tank T after passing through water Wa and surfactant solution S, thereby $Cl_2$ being reduced. Molecules of said methylene chloride gas are finer than those of said chloride in the aqueous state and, therefore, easily permeate into fine pores of wood W and oxidize resin thereat.

Methylene chloride entering pores of wood while mixed with surfactant solution S sharpens dissolution of resin and production of a large quantity of methylene chloride gas at a low temperature makes needless a high temperature for processing in the tank T.

In this embodiment, a description is made on processing of the natural wood, however, a method of and apparatus for processing wood according to this invention is applicable to repair.restoration of carved wooden work such as an old Buddha image carved several tens, several hundreds, or several thousands years ago. In other words, resin remaining in the inner part of the carved work can be dissolved through such processes as putting said old carved work in the processing tank T and applying mixture solution gas of methylene chloride, water, and surfactant thereto, whereby soil and soot on the surface of said work are all washed out. Washing of the inner part of the cell of the old carved wood as an old Buddha image is enabled by the process as described above. The washing process also exhibits sterilizing effect and the carved work can be displayed in the exhibition room kept at a constant temperature because the surface of the work hardens after elution of resin. In the process of repair.restoration of old works, regardless of the wooden carved work, washing is applicable to even narrow wooden strips digged out from the remains of an old age and other wooden relics. Washing as above ensures a long term preservation of wooden works.

Wood to be processed according to this invention may be in the form of chip as the material used in the paper making industry and the paper making process can be simplified by removal of oils and fats using a mixture of methylene chloride solvent solution, water, and surfactant solution prepared according to this invention.

(Action of the Invention)

The action of the invention will be described. Referring to FIGS. 8 and 9, halogenated hydrocarbon gas used in this invention, particularly, methylene chloride gas, steam, and surfactant gas permeate into the pit part of wood and dissolve cellulose.microfibrils composing the margo part 32 of wood so as to make the torus 31 incapable of closing the pit 30. When the pit 30 is opened, resin content in the cell is dissolved by methylene chloride gas and is eluted to the outside. With the bit 30 opened, resin and moisture are easily extracted by subsequent drying process. Permeation of dyestuff, preservatives, or synthetic resin into the wood cell after extraction of oils and fats is so easy that chemically reinforced wood W is obtained. In this processing method in which a mixture is prepared by adding surfactant to methylene chloride solution and water, surfactant gas makes separation and flowing out of eluted resin easy, and malic, citric, succinic, and acetic acids among organic ones generated by chemical reaction of mixture gas as described above promote color development and improve the luster of wood. Addition of surfactant to the mixture solution enables generation of gas at a low temperature and reduces carbonization of wood thanks to a low processing temperature.

(Effects of the Invention)

This invention composed as above exhibits the following effects.

Since the mixture of methylene chloride gas, surfactant gas, and steam enables opening of the bit part 30 of wood W, above all, inclusion of surfactant enables improvement in sharpness in removal and separation of dissolved resin from the pit. Therefore, processing of wood on one hand, in which the structure of wood is adapted to absorb surfactant gas besides pressurized methylene chloride gas and steam, improves resin-dissolving effect three times higher than that of processing on the other hand to immerse wood into methylene chloride solution, whereby speed in drying of wood is significantly increased and injection of dyestuff, preservatives, and synthetic resin into the depth of wood is enabled.

If methylene chloride gas not having passed through the layer of water Wa is directly fed to pores of wood W, the structure of wood W suffers an excessive content of $Cl_2$, is damaged to dissolve resin, and requires a period of about one month for natural drying to remove methylene chloride gas after processing in the end. Even after natural drying, damage to the wood structure is caused and favorable nature of wood is lost. In the case of direct immersion of wood into methylene chloride solution, fat removing power of said solution is too strong and impairs the structure of wood.

Accordingly, wood is changed in quality after dried so to be incapable of maintaining satisfactory nature as wood. In this invention, since a mixture of water Wa, surfactant solution S, and methylene chloride solution Me is prepared and gas of methylene chloride Me is fed to wood after passed through the layers of both water Wa and surfactant solution S, $Cl_2$ as a constituent of HCl is absorbed into water and inflicts no damage to wood because of reduced rate of generation thereof, and methylene chlorided gas is easily absorbed and recovered by reducing pressure in the processing tank T to be negative and vacuum in the end. Damage to the structure of wood W is not caused after recovery of methylene chloride. Recovery of methylene chloride gas is performed promptly and completely and can be re-used with the progress of cooling and liquefaction. In this way, consumption of methylene chloride solution Me and cost of processing can be reduced.

Mixing of surfactant solution with water and methylene chloride solution enables promotion of vaporization of methylene chloride solution and water at a low temperature. Water usually vaporizes at the temperature of 100° C., however, can vaporize at a low temperature as a result of addition of surfactant thereto, and, therefore, sufficient pressure can be obtained at a temperature ranging from 40° to 80° C. as the highest, whereby carbonization of wood can be prevented thanks to no need of high pressure at the high temperature over 80° C.

Mixing of surfactant with water and methylene generates organic acids as phosphoric, citric, pyruvic, malic, succinic, lactic, formic, acetic, levulnic, pyloglutamic, propionic, isobutylic, isovaleric acids, and, among these acids, phosphoric acid improves development of yellow color, citric acid and succinic acid are effective for development of pink color whereas acetic acid serves for decoloration for providing whiteness. These actions remove reddish color of such wood as generally called "red cedar" or "black core" and disliked in the market as low quality one, and discolor black core parts so that said wood may be moderate in color and changed into a high quality one.

Not only a speed for drying wood W processed as above is made higher about three times of that required in the conventional manner using methylene chloride only and water, but also drying of wood, in which decrease in moisture content lower than a certain balanced rate has so far been impossible because of closure of the pit 30 even if using hot air, is made possible to provide a further lower moisture content by opening the pit 30 and breaking the state of balanced moisture content.

In contrast with dyeing of processed wood W which has hitherto been applicable to the surface of wood W only, coloring according to this invention can be uniformly applied to even the inner part of wood W. Injection of preservatives and reinforcing agents of synthetic resin can easily be performed.

Since deaeration from wood in the processing tank made vacuum in the step prior to permeation of methylene chloride gas, steam, and surfactant gas, permeation of methylene chloride into the inner part of wood W in the vacuum state is enabled and progresses as deeply as enabling opening of the pit.

The conventional method of processing for repairing and restoring the remains of wooden work buried in the ground for a long period of age, in which physical processing only is applied to the surface of the work or resin is absorbed only by the surface of the cultural properties, is substituted by a new method to elute resin from the internal part of the work composing wood for enabling chemical washing. In this way, stains remaining on the surface of the wooden work or having permeated thereinto can be washed out and an appearance of the work approximate to that at the time of manufacturing said work is restored, whereby the surface of work can be hardened after processed and secondary processing is not required.

The use of chips as the material of paper making instead of the solid wood allows removal of oils and fats from the wood cell and chip dissolving process can be simplified.

I claim:

1. A method for processing wood with vapor, comprising the steps of:

(a) introducing methylene chloride liquid, water, and surfactant liquid into a treatment chamber at a weight ratio of approximately 5:4:1 respectively, wherein said methylene chloride liquid and water are not substantially miscible, and a layer of said methylene chloride liquid is under that of said water and surfactant liquid;

(b) placing wood inside said chamber in such a way that said wood does not touch said methylene chloride liquid;

(c) heating said methylene chloride liquid, water and surfactant liquid to a temperature not lower than the boiling point of said methylene chloride but not higher than 80° C. so as to fill said chamber under hermetic conditions with the vapors of said methylene chloride, water and surfactant under, wherein the vapor of said methylene chloride generated from said layer of said methylene chloride liquid passes through the overlying layer of water and surfactant liquid;

(d) exposing said wood to the vapors of said methylene chloride, water and surfactant in said chamber for a time sufficient to dissolve oils and resin from said wood in said vapors; and (e) cooling the inside of said chamber to a temperature below the boiling point of said methylene chloride.

2. The method for processing wood according to claim 1, further comprising removing the vapor-treated wood from said chamber after step (e), and drying said wood.

3. The method for processing wood according to claim 1, wherein said surfactant is polyoxyethylene alkylphenol.

4. The method for processing wood according to claim 1, further comprising subjecting said wood to deaeration between steps (b) and (c).

5. The method for processing wood according to claim 2, further comprising impregnating the dried wood with a treatment substance.

6. The method for impregnating wood with a treatment substance according to claim 5, wherein said treatment substance is dyestuff, preservative, and/or synthetic resin.

* * * * *